US005301654A

United States Patent [19]

Weber, III et al.

[11] Patent Number: 5,301,654

[45] Date of Patent: Apr. 12, 1994

[54] HEAT-EXCHANGER ESPECIALLY FOR FORCED AIR FURNACES

[75] Inventors: Richard H. Weber, III, Lafayette; Paul T. Richardson, Indianapolis; David E. Langenkamp, Lafayette; Gerald K. Gable, Carmel, all of Ind.

[73] Assignee: Consolidated Industries Corp., Lafayette, Ind.

[21] Appl. No.: 922,073

[22] Filed: Jul. 29, 1992

[51] Int. Cl.[5] ..... F24H 3/02

[52] U.S. Cl. ..... 126/110 R; 126/116 R; 126/99 A; 165/145

[58] Field of Search ..... 126/110 R, 116 R, 99 A; 165/145, 144, 168, 76, 178, 173, 143

[56] References Cited

U.S. PATENT DOCUMENTS 3,079,910 3/1963 Bloom et al. .
3,111,939 11/1963 Peoples .
3,358,672 12/1967 Dirk et al. .
3,661,140 5/1972 Raleigh .
3,774,587 11/1973 Mutchler .
3,822,691 7/1974 Mutchler .
4,848,314 7/1989 Bentley .
4,877,014 10/1989 Beasley ..... 126/116 R
4,878,837 11/1989 Otto .
4,883,423 11/1989 Holowczenko .
4,926,840 5/1990 Shellenberger et al. ..... 126/110 R
4,947,548 8/1990 Bentley .
4,951,651 8/1990 Shellenberger .
5,042,453 8/1991 Shellenberger ..... 126/116 R X

*Primary Examiner*—Larry Jones
*Attorney, Agent, or Firm*—Victor E. Libert; Frederick A. Spaeth

[57] ABSTRACT

A forced air furnace (11) has a heat exchanger (35) with one or more tube pack assemblies (10). Each tube pack assembly (10) has a burner (21) situated to fire into a primary fire tube (30) which is mechanically connected through a transition cap (36) to a plurality of secondary tubes (37, 38, 39, 41) returning combustion products from the primary fire tube (30) to a collection manifold (24) at the intake end of a draft inducer assembly (23) for discharge of the combustion products to a flue. In the preferred embodiment, the transition cap (36) is connected to the primary fire tube (30) and to the secondary tubes (37, 38, 39, 41) by a mechanical interlock.

13 Claims, 3 Drawing Sheets

HEAT-EXCHANGER ESPECIALLY FOR FORCED AIR FURNACES

BACKGROUND OF THE INVENTION

1. Field of the Invention

This invention relates generally to forced air furnaces, and more particularly to a heat exchanger construction for high efficiency furnaces for central heating systems.

2. Description of the Prior Art

Many gas-fired forced air furnaces for residential use comprise a plurality of clamshell-type heat exchange units, each clamshell unit comprising two formed sheet metal shells welded or otherwise secured together. The units share a ribbon-type burner at the bottom of the heat exchanger to introduce hot combustion products into the inlets of the clamshell units and an exhaust plenum at the top into which the combustion products flow from the outlets of the clamshell units.

U.S. Pat. No. 4,947,548 issued Aug. 14, 1990 to Bentley discloses a dual stage clamshell heat exchanger providing a plurality of condensing heat exchange cells 52 coupled to a lesser number of primary heat exchange cells 32. There may be four condensing heat exchange cells 52 for each primary heat exchange cell 32 (see column 3, lines 29–31), but the coupling boxes 50 do not associate condensing heat exchange cells with individual primary heat exchange cells.

While the clamshell units are comparatively inexpensive, other designs have been pursued as well.

U.S. Pat. No. 3,661,140, issued May 9, 1972 to Raleigh, discloses a furnace using an induced draft blower and a plurality of "heat cells" 40 providing a generally tubular combustion product flow path from the gas burners 48 to the discharge opening 60 into the flue gas collector chamber 77 from which the combustion products are discharged by the "combustion suction fan 78".

More recent patents showing tube-type heat exchangers include U.S. Pat. No. 4,926,840, issued May 22, 1990 to Shellenberger et al, and U.S. Pat. Nos. 5,042,453, issued Aug. 27, 1991 and 4,951,651, issued Aug. 28, 1990, both to Shellenberger. These patents all show heat exchangers comprising a plurality of fire tubes into which gaseous combustion products are directed. A second plurality of tubes smaller in diameter than tubes in the first plurality is coupled to the first plurality of tubes by a manifold. In U.S. Pat. No. 5,042,453, the smaller tubes are shown as being coupled at their outlet ends to a manifold 16 by means of a weldless swedge joint 42.

SUMMARY OF THE INVENTION

The present invention relates to an improvement in a furnace for a forced air heating system. Such a furnace has a blower chamber having a return air inlet in air flow communication with a heat exchange chamber having a heated air outlet to accommodate the movement of air in a primary path from the return air inlet through the heat exchange chamber to the heated air outlet. A heat exchanger dimensioned and configured to have combustion products flow therethrough is located in the heat exchange chamber to heat air flowing in the primary path. The improvement comprises that the heat exchanger comprises at least one tube pack assembly comprising a single primary fire tube having an inlet and an outlet and extending transversely to the primary path and having at least one reverse bend. The tube pack assembly further comprises a plurality of secondary tubes exclusively associated in combustion product flow communication with the primary fire tube. Each secondary tube has an inlet and an outlet and extends transversely to the primary path, and has at least one reverse bend. There is a transition cap coupling the outlet of the primary fire tube to each of the inlets of the associated secondary tubes to connect the primary fire tube in combustion product flow communication with its associated secondary tubes.

According to one aspect of the invention, the primary fire tube comprises an outlet leg and each of the secondary tubes comprise an inlet leg in line with the outlet leg of the primary fire tube. The transition cap accordingly provides an in-line connection between the primary fire tube and the secondary tubes.

According to another aspect of the invention, the heat exchange chamber has a rear wall and each primary fire tube comprises a reverse bend portion near the rear wall, and each of the associated secondary tubes comprise a reverse bend portion near the rear wall. The primary fire tube may comprise a second reverse bend portion whereby the primary fire tube is generally S-shaped and may comprise leg portions which extend transversely with respect to the primary path of the heated air.

Another aspect of the invention provides that the transition cap may comprise a peripheral flange dimensioned and configured to mate with the outlet end of the associated primary fire tube and a plurality of intermediate flanges dimensioned and configured to mate with the inlet ends of the secondary tubes.

Still another aspect of the invention provides that each transition cap may be connected to the primary and associated secondary tubes by mechanical interlocks.

In a heat exchanger according to the present invention, the ratio of cross-sectional flow area of the primary fire tube to the total cross-sectional flow area of the associated secondary tubes may be in the range from about 1.5:1 to 4.0:1. Preferably, the ratio is about 2.85:1.

The ratio of the cross-sectional flow area of the primary fire tube to the cross-sectional flow area of each of the associated secondary tubes may be in a range of from about 15:1 to 6:1. Preferably, the ratio is about 11.4:1. The ratio of the length of the primary fire tube to the length of each of the associated secondary tubes may be in a range of from about 1.15:1 to about 2.2:1. For example, the ratio may be 1.35:1.

DETAILED DESCRIPTION OF THE PREFERRED EMBODIMENT

Figure 1:
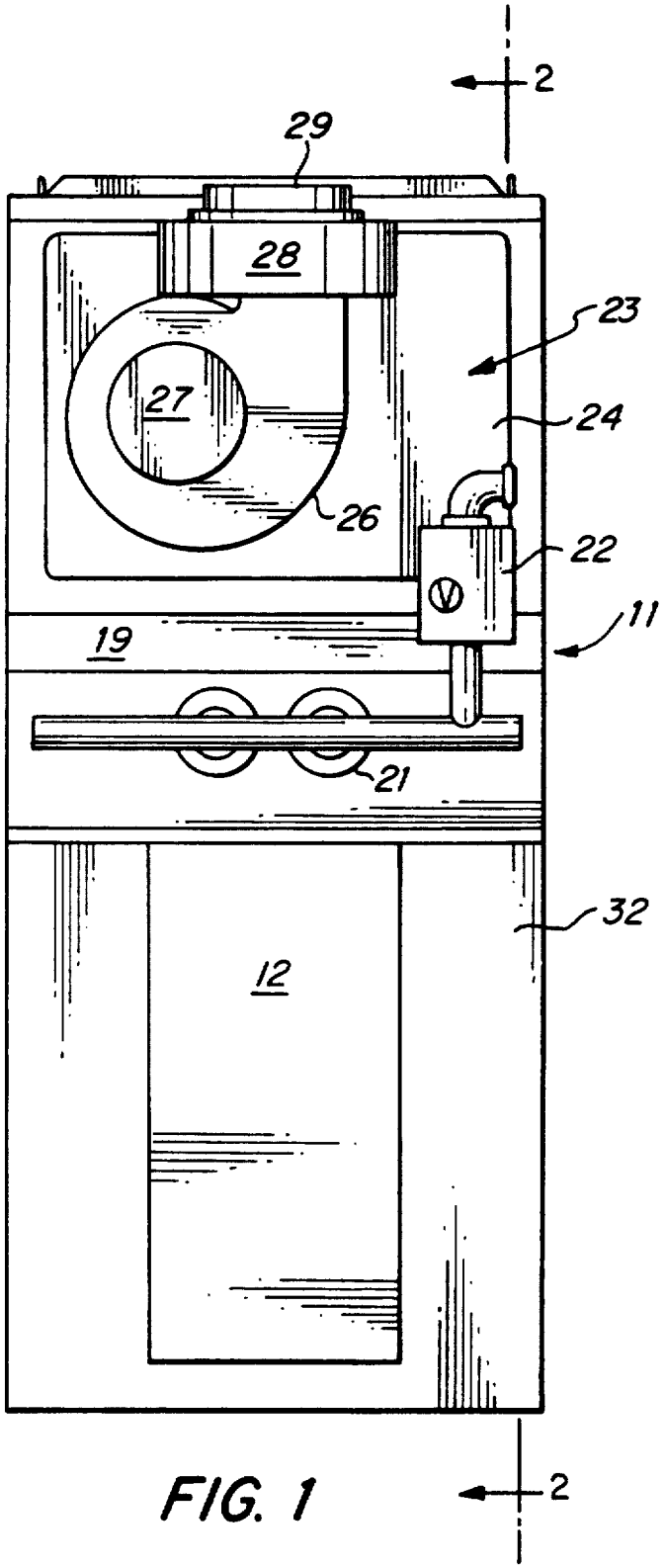
FIG. 1 is a front elevational view of a furnace according to a typical embodiment of the present invention, but with the front outer door and inner blower access door removed.

The present invention is directed to improved heat exchanger construction using the discrete tube approach in an arrangement intended to meet current Federal government requirements for efficiency in gas-fired residential heating furnaces while maintaining reliability and reasonable cost.

A furnace according to the present invention comprises a heat exchanger having a primary fire tube into which hot combustion gases are introduced from a burner. The combustion gases exit the primary fire tube and flow through a transition cap into a plurality of secondary tubes, each of which is preferably smaller in diameter than the primary tube. The association between the secondary tubes and the primary fire tube is exclusive in that the transition cap only allows combustion products to flow from the one primary fire tube into the associated secondary tubes. The transition cap is also dimensioned and configured to reduce concave formations in the heat exchanger within which condensate may pool, thereby reducing the opportunity for corrosion within the heat exchanger. Preferably, the transition cap mates with the primary fire tube and the secondary tubes by means of a mechanical interlock, thus avoiding the need to weld the cap to the tubes. Preferably, the cap is positioned between a horizontally disposed outlet leg of the primary fire tube and horizontally disposed inlet legs of the secondary tubes and is dimensioned and configured to provide an in-line connection between them. The in-line connection is believed to enhance the longevity of the mechanical interlock connection between the tubes and the transition cap by reducing stresses caused by thermal expansion and contraction which occur during fire-up and cool-down periods of furnace operation. These stresses may also be reduced by choosing primary and secondary tubes having appropriate relative lengths and cross-sectional flow areas. The furnace may also comprise other components such as a primary blower for forcing air to be heated through the heat exchange chamber, control apparatus for the burners, etc.

Referring now to the drawings, a gas furnace 11 is shown with the front outer door and the inner blower access door removed. It is an up-flow furnace with a direct drive blower 12 in blower chamber 13 taking air through a return air inlet 102 at the bottom of furnace 11, although the return air inlet could be located at either side of, or at the rear of, the chamber, depending upon furnace mounting. Blower 12 forces air to be heated up in a primary path through the heat exchange chamber 14 in the direction of the outlined arrow to be emitted at the heated air outlet 16 which is framed by flanges 17 for connection in conventional manner to a discharge plenum or hot air duct. A heat exchanger 35 is situated in heat exchange chamber 14, mounted therein at interior front wall 19 for heating the air moving on the primary path. Various other components of the furnace may be disposed in access chamber 15 including, for example, burners 21 for introducing hot combustion products into the inlets of the primary fire tubes, gas control 22 for controlling the flow of fuel to burners 21, a draft inducer assembly 23 for drawing gaseous combustion products from the heat exchanger 35, and other components conventionally incorporated into such furnaces, as is known in the art. The draft inducer assembly 23 includes combustion gas collection manifold 24 in gas flow communication with the outlets of the secondary tubes, inducer fan housing 26, inducer blower motor 27, discharge chamber 28, and stack adapter 29, to which the exterior vent connector (not shown) may be attached to vent combustion products from the furnace. Access chamber 15 is bounded by interior wall 19 and the front door panel 20 (FIG. 2) of the furnace housing. Interior wall 19 may comprise a plurality of panels, e.g., upper panel **19*a* and lower panel 19*b*, and may be configured to have a recessed portion 25 to accommodate the burners 21. A blower access door 18 may be mounted in interior wall 19 to allow access to blower 12 via access chamber 15, to allow maintenance personnel to inspect or repair blower 12**.

Figure 2:
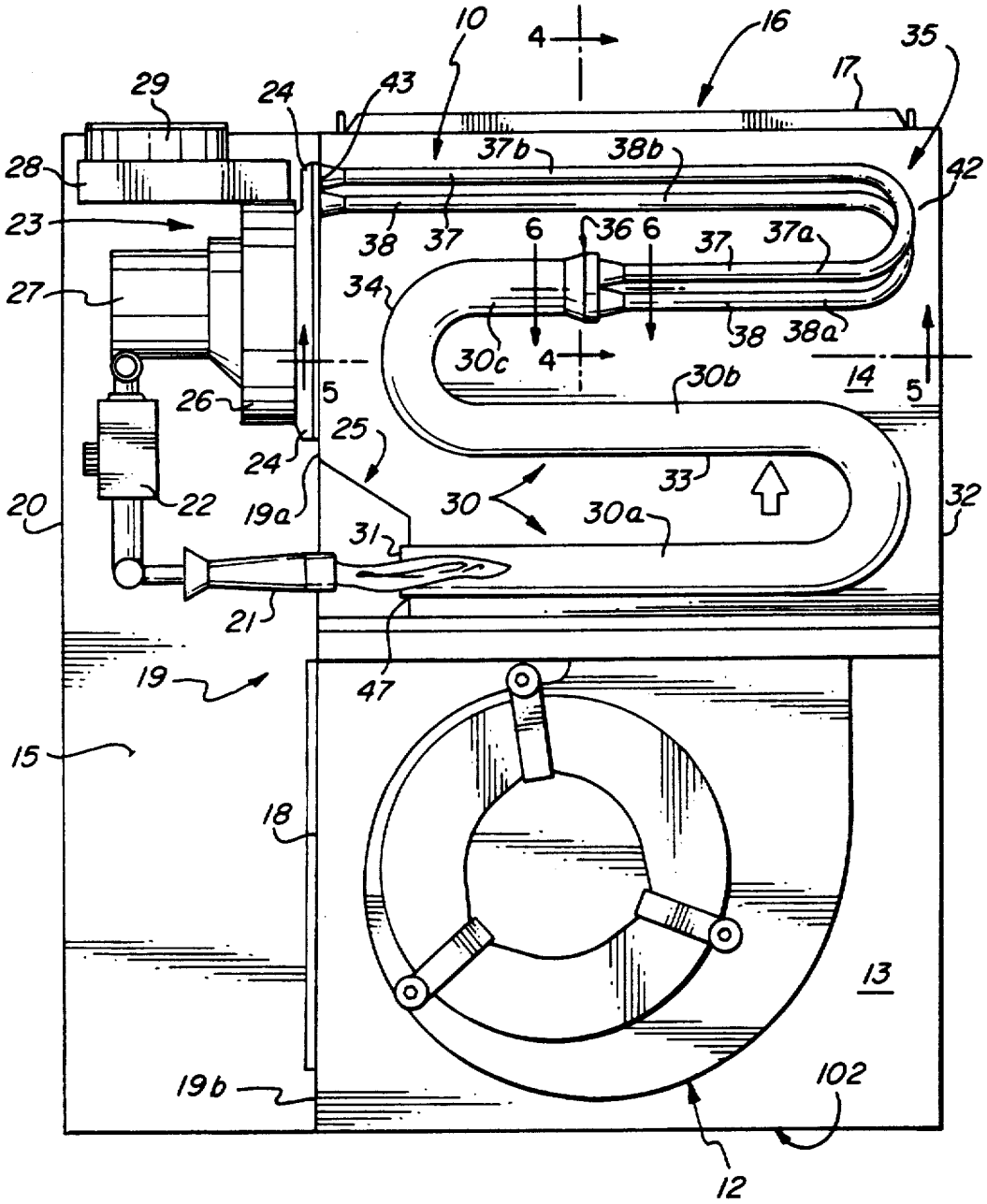
FIG. 2 is a cross-sectional view of the furnace of FIG. 1 taken at line 2—2 in FIG. 1 and viewed in the direction of the arrows showing a tube pack assembly according to the present invention.
Figure 3:
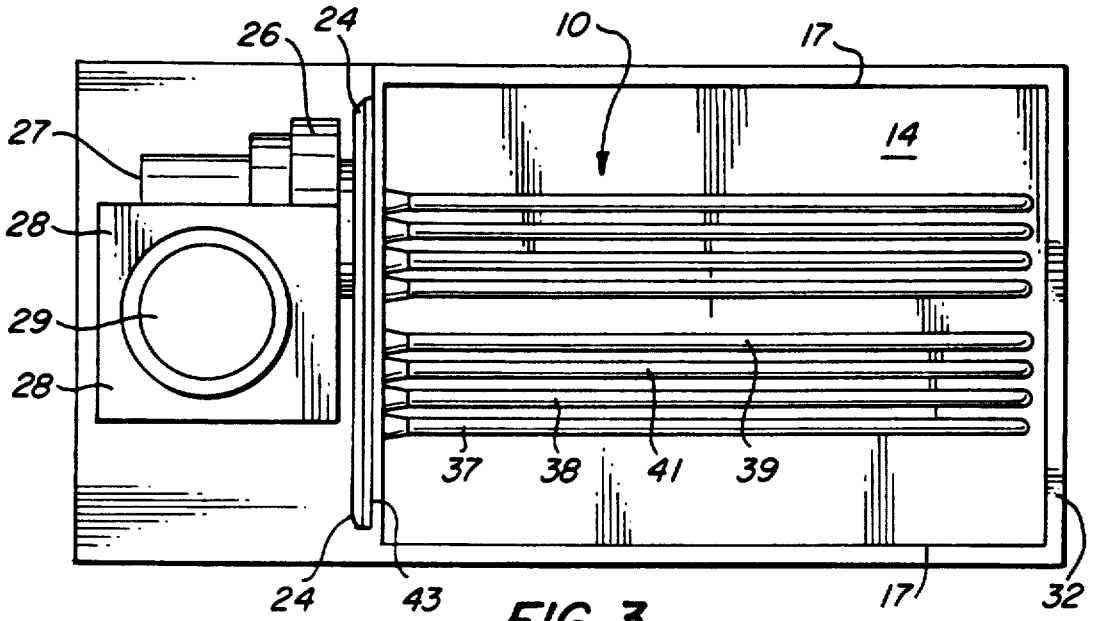
FIG. 3 is a top plan view of the furnace of FIG. 1 with the top panels removed.

According to one embodiment of the present invention, the heat exchanger 35 disposed within heat exchange chamber 14 comprises at least one "tube pack assembly" 10, one of which is illustrated in FIG. 2 and FIGS. 4, 5 and 6; two of which are shown in FIG. 3. Each tube pack assembly 10 comprises a single primary fire tube 30 (FIG. 2), a transition cap 36 and a plurality of secondary tubes 37, 38, 39 and 41. Each primary fire tube has an inlet end 31 at the recess in front wall 19 to receive hot combustion products from burners 21. The primary fire tube 30 has a first leg **30*a* which extends rearward from front wall 19 toward the rear wall 32 of heat exchange chamber 14 and transversely to the primary path of air passing through the heat exchange chamber. The tube bends upward and forward to complete a 180° turn and comprises a second leg 30*b* which extends forward toward interior front wall 19. The fire tube again bends upward to complete a 180° turn and has an outlet leg 30*c* which extends toward rear wall 32. Outlet leg 30*c* ends at a point between interior front wall 19 and rear wall 32 and between the two reverse bends in primary fire tube 30**.

A transition cap 36 couples the outlet of primary fire tube 30 to the inlets of a plurality of associated secondary tubes 37, 38, 39 and 41 and provides combustion product flow communication between the respective outlet and inlets. These secondary tubes comprise inlet legs, e.g., **37*a* and 38*a*, which extend from their respective inlet ends at transition cap 36 toward the rear wall 32. The secondary tubes then bend forward and comprise outlet legs, e.g., 37*b* and 38*b*, which extend toward interior front wall 19, where they terminate in outlets. The outlets of the secondary tubes are coupled through interior front wall 19 via breeching plate 43 to manifold 24 and thus into inducer assembly 23, which provides a draft for withdrawing combustion products from heat exchanger 35 and vents them to a vent stack (not shown) via discharge chamber 28**. While the illustrated embodiment comprises four secondary tubes associated with the primary fire tube there may be a lesser or greater number of secondary tubes associated with the primary fire tube.

Figure 4:
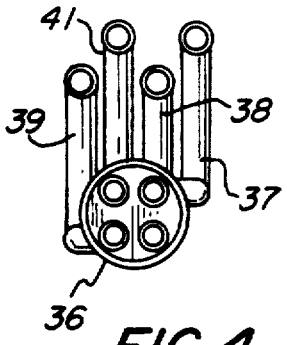
FIG. 4 is a cross-sectional view of the tube pack assembly shown in FIG. 2 taken at line 4—4 and viewed in the direction of the arrows and enlarged with respect to FIG. 2.

To avoid interference between secondary tubes having vertically aligned inlets, it may be necessary to provide some of the secondary tubes with a slight lateral bend. For example, it will be appreciated by viewing FIG. 2 that because the inlets of secondary tubes 37 and 38 are vertically aligned, they cannot both bend upward since tube 37 would obstruct tube 38. Accordingly, one of the tubes may comprise a lateral bend sufficient to provide clearance between the respective reverse bends and outlet legs. Thus, as best seen in FIG. 5, inlet leg 37*a* of secondary tube 37 comprises a slight lateral bend which displaces the tube sufficiently to provide clearance from secondary tube 38, so that the two extend upwardly side by side as seen in FIG. 4.

Figure 5:
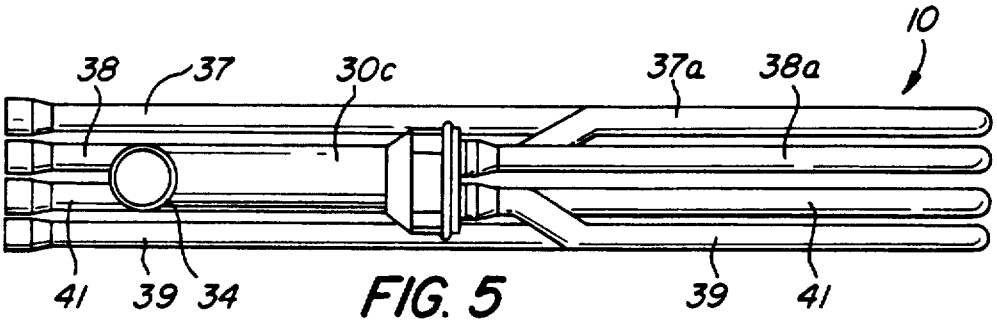
FIG. 5 is a cross-sectional view of the tube pack assembly shown in FIG. 2 taken at line 5—5 and viewed in the direction of the arrows and on about the same scale as FIG. 4.
Figure 6:
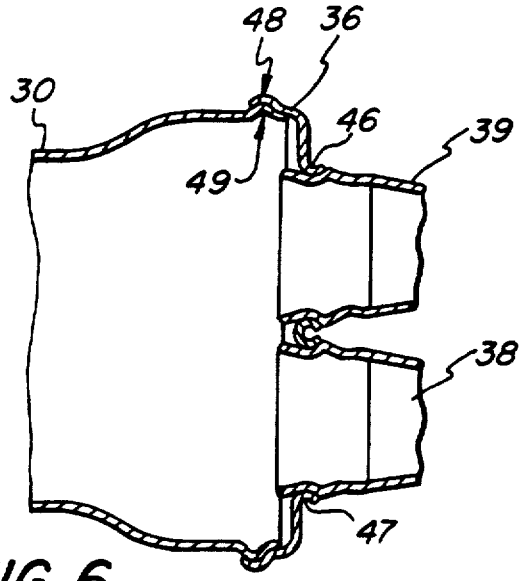
FIG. 6 is a cross-sectional view of the tube pack assembly shown in FIG. 2, taken at line 6—6 and viewed in the direction of the arrows and enlarged with respect to FIG. 2.

Transition cap 36 is seen in more detail in FIG. 5 and FIG. 6, which show that transition cap 36 is generally disc-shaped and has a peripheral flange 48 adapted to receive the outlet of primary fire tube 30. Transition cap 36 is equipped with a plurality of apertures, there being one aperture for each secondary tube and each aperture being encircled by an intermediate flange and being adapted to receive the inlet ends of the secondary tubes. Transition cap 36 may be attached to the fire tubes in a manner which does not require welding, such as by a mechanical interlock. For example, the outlet end of primary fire tube 30 may have a rib 49 around which peripheral flange 48 may be crimped. Conversely, the intermediate flanges 46, 47 may have a convex curvature with respect to the apertures they encircle and the inlet ends of the secondary tubes may have a radial corrugation for receiving the intermediate flanges, as seen in FIG. 6.

To increase the heat exchange capacity of the furnace, two or more burners may be employed, and heat exchanger 35 may comprise a tube pack assembly associated with each burner. The tube pack assemblies may be disposed side by side in the heat exchange chamber, as shown in FIG. 3.

The furnace comprising tube pack assemblies according to the present invention operates in a conventional manner, i.e., upon demand (which may be signalled by a thermostatic switch), the furnace is fired up, i.e., burners 21 are ignited and inducer assembly 23 draws the combustion products through the heat exchanger. Blower 27 forces return air through the heat exchange chamber and heated air is emitted through heated air outlet 16 to a heating duct (not shown) to direct the heated air to the area to be heated.

As is known in the art, the change in temperature of the heat exchanger produced at fire-up causes thermal expansion of the metallic elements of the heat exchanger, which causes mechanical stress. This stress degrades the strength and durability of the couplings between the various components of the heat exchanger. In particular, the couplings of the primary and secondary tubes to transition cap 36 are subjected to stress produced by thermal expansion of the fire tubes. Preferably, heat exchanger 35 is dimensioned and configured so that the stress resulting from thermal expansion and contraction of the fire tubes does not cause undue distortion of the couplings therein. This is desirable not only to prolong the functional life of the heat exchanger but also to limit, or preferably prevent, leakage of return air from the heat exchange chamber into the tubes of the heat exchanger. Such leakage adversely affects the heat transfer efficiency of the heat exchanger and may also affect the combustion efficiency of the burners.

One way to reduce structural distortions of the couplings to transition cap 36 is to position transition cap 36 so that it joins straight, aligned segments of the primary and secondary tubes. Such a configuration is referred to herein and in the claims as "in-line connection". In addition, the inlet legs of the secondary tubes are symmetrically disposed about the outlet leg 30*c* of primary fire tube 30 so that transition cap 36 is not subjected to a torque when the fire tubes expand. Such a configuration is illustrated in FIG. 2 and FIG. 4, where it is seen that transition cap 36 is configured to provide a straight flow path from the outlet leg 30*c* of primary fire tube 30 into the inlet legs of secondary tubes 37, 38, 39 and 41, and that the inlets of the secondary tubes are disposed in a symmetric, four point array. This configuration thus differs from that shown in U.S. Pat. No. 4,951,651 to Shellenberger dated Aug. 28, 1990, which illustrates a transition manifold 38 between small diameter tubes 42 and large diameter tubes 32 and through which the combustion products must pass in a right angle path. Since both the primary and the secondary tubes have legs which terminate at front wall 19 of the furnace and extend transversely to the primary path, the primary and the secondary tubes must comprise at least one reverse bend and either the primary fire tube or the secondary tubes must comprise a second reverse bend so that an in-line connection can be achieved. As shown in FIG. 2, primary fire tube 30 has two reverse bends; but in other embodiments primary fire tube 30 could be configured to have only one reverse bend and thus to terminate at a point within leg 30*b*, and the secondary tubes would then comprise a second reverse bend to provide inlet legs to couple with leg 30*b* of the primary fire tube. Thus, both the primary fire tube and the secondary tubes comprise at least one reverse bend, and either one of the primary or the secondary tubes comprise a second reverse bend.

In addition to providing a transition cap well situated and configured to withstand the stress of thermal expansion and contraction of the heat exchanger, the configuration of transition cap 36 avoids the accumulation therein of condensation products which may form when the heat exchanger cools, e.g., during the operation of an air conditioning system that passes cooled air through the primary path of the furnace. Such condensation products, originally introduced in vapor form into the tubes of the heat exchanger, condense therein upon cooling and can cause corrosion if allowed to accumulate. The transition cap 36 according to the present invention allows only a minimum of condensate to pool therein in a concavity indicated by the dotted line in FIG. 6. In any configuration in which the legs of the fire tubes are disposed horizontally and in which the secondary tubes are disposed at least slightly higher than the primary fire tube, any condensate in excess of the small amount which may pool in transition cap 36 will trickle downward through the serpentine path of the heat exchanger to be discharged from the inlet ends of the primary fire tubes, and then drained or otherwise disposed of. The transition cap according to the present invention therefore provides an advantage over transition manifolds of the prior art such as those illustrated in U.S. Pat. No. 4,951,651 (Shellenberger) within which significant quantities of condensate can accumulate and cause corrosion.

Another consideration for reducing the stress produced by thermal expansion is to select a primary fire tube and associated secondary tubes having appropriate dimensional proportions. The proportions which may be taken into consideration include the overall relative lengths of the tubes, the relative lengths of the legs of the tubes which are coupled to transition cap 36, the relative diameters and cross-sectional areas of the tubes and the relationship between the radius of curvature of the bends in the tubes and the tube diameters. To provide efficient heat exchange, it is preferred that the ratio of the cross-sectional flow area of the primary fire tube to the total cross-sectional area of the associated secondary tubes be in the range of from about 1.5:1 to 4.0:1, wherein the ratio of the diameter of the primary fire tube to the diameters of the secondary tubes would be about 3.1:1.

In a specific configuration which was found to provide adequate durability at the various couplings in the heat exchanger as well as adequate heat exchange efficiency, the primary fire tube 30 had an outside diameter of 4.45 centimeters ("cm") (1.75 inches) and the secondary tubes 37, 38, 39 and 41 each had an outside diameter of 1.43 cm (0.56 inches). The tube wall thicknesses were all from about 0.081 cm (0.032 inches) to about 0.107 cm (0.042 inches). Accordingly, the ratio of the cross-sectional flow area of the primary fire tube to the total cross-sectional area of the secondary tubes was about 2.85:1.

The overall centerline length of the primary fire tube 30 was 108.2 cm (42.6 inches) from the inlet to the outlet, and the length of first leg 30*a* of fire tube 30 measured from the inlet of fire tube 30 to the beginning of the first reverse bend was 34.1 cm (13.4 inches). The radius of curvature of the first reverse bend measured to the center of the tube was 5.72 cm (2.25 inches) and the distance of the first reverse bend from rear wall 32, measured at its nearest point to the wall was 1.27 cm (0.5 inches). The length of leg 30*b* of primary fire tube 30, measured from the end of the first reverse bend to the beginning of the second reverse bend in primary fire tube 30 was 28.2 cm (11.1 inches). The second reverse bend was, at its nearest point to front wall 19, 3.37 cm (1.32 inches) from that wall and it had a radius of curvature of 5.72 cm (2.25 inches). The length of outlet leg 30*c* of primary fire tube 30, measured from the end of second reverse bend to the transition cap 36 was 9.98 cm (3.93 inches).

The overall centerline length of secondary tube 27 from the inlet to the outlet was 78.9 cm (31.1 inches). The length of leg 37*a* of secondary tube 37, measured from the inlet to the beginning of the reverse bend was 22.7 cm (8.9 inches). The radius of curvature of the reverse bend in the secondary tubes was 3.81 cm (1.5 inches). The length of outlet leg 37*b*, measured from the end of reverse bend 42 to the outlet at interior front wall 19 was 44.8 cm (17.6 inches). The ratio of lengths of the primary fire tube to the secondary tubes should be about 1.3:1. The primary fire tube, secondary tubes and transition cap were all made of aluminized steel.

While the invention has been described in detail with reference to a particular embodiment, it will be apparent that upon a reading and understanding of the foregoing, numerous alterations to the described embodiment will occur to those skilled in the art and it is intended to include such alterations within the scope of the appended claims.

What is claimed is:

1. In a furnace for a forced air heating system having a blower chamber having a return air inlet and communicating with a heat exchange chamber having a heated air outlet to accommodate the movement of air in a primary path from the return air inlet through the heat exchange chamber to the heated air outlet, a heat exchanger dimensioned and configured to have combustion product flow therethrough and located in the heat exchange chamber, the improvement comprising:

at least one tube pack assembly comprising a single primary fire tube having an inlet and an outlet and extending transversely to the primary path and having at least one reverse bend, the tube pack assembly further comprising a plurality of secondary tubes exclusively associated in combustion product flow communication with the primary fire tube, each secondary tube having an inlet and an outlet and extending transversely to the primary path and having at least one reverse bend; and a transition cap coupled to the outlet of the primary fire tube and to each inlet of the associated secondary tubes to connect the primary fire tube in combustion product flow communication with its associated secondary tubes.

2. The heat exchanger of claim 1 wherein the primary fire tube comprises an outlet leg and the secondary tubes each comprise an inlet leg in line with the outlet leg of the primary fire tube, and wherein the transition cap provides an in-line connection between the primary fire tube and the secondary tubes.

3. The heat exchanger of claim 1 or claim 2 wherein the heat exchange chamber has a rear wall and each primary fire tube comprises a reverse bend portion near the rear wall, and each of the associated secondary tubes comprises a reverse bend portion near the rear wall.

4. The heat exchanger of claim 1 or claim 2 wherein the transition cap comprises a peripheral flange dimensioned and configured to mate with the outlet end of the associated primary fire tube and a plurality of intermediate flanges dimensioned and configured to mate with the inlet ends of the secondary tubes.

5. The heat exchanger of claim 1 or claim 2 wherein each transition cap is connected to the primary and associated secondary tubes by mechanical interlocks.

6. The heat exchanger of claim 5 wherein a primary fire tube comprises two reverse bend portions whereby the primary fire tube is generally S-shaped and comprises leg portions which extend transversely with respect to the primary path of the heated air.

7. The heat exchanger of claim 1 or claim 2 wherein the ratio of cross-sectional flow area of the primary fire tube to the total cross-sectional flow area of the associated secondary tubes is in the range from about 1.5:1 to 4.0:1.

8. The heat exchanger of claim 7 wherein the ratio of cross-sectional flow area of the primary fire tube to the total cross-sectional flow area of the associated secondary tubes is about 2.85:1.

9. The heat exchanger of claim 1 or claim 2 wherein the ratio of the cross-sectional flow area of the primary fire tube to the cross-sectional flow area of each of the associated secondary tubes is in a range of from about 15:1 to 6:1.

10. The heat exchanger of claim 9 wherein the ratio of the cross-sectional flow area of the primary fire tube to the cross-sectional flow area of each of the associated secondary tubes is about 11.4:1.

11. The heat exchanger of claim 1 or claim 2 wherein the ratio of the length of the primary fire tube to the length of each of the associated secondary tubes is in a range of from about 1.15:1 to about 2.2:1.

12. The heat exchanger of claim 1 or claim 2 comprising a plurality of tube pack assemblies, each tube pack assembly comprising a transition cap to connect a single primary fire in combustion product flow communication with a plurality of secondary tubes associated exclusively therewith.

13. The heat exchanger of claim 1 wherein the secondary tubes are disposed in a symmetric array on the transition cap.

* * * * *

UNITED STATES PATENT AND TRADEMARK OFFICE

CERTIFICATE OF CORRECTION

PATENT NO. : 5,301,654

DATED : April 12, 1994

INVENTOR(S) : Richard H. Weber, III et al

It is certified that error appears in the above-indentified patent and that said Letters Patent is hereby corrected as shown below:

In column 7, line 39, replace "27" with --37--.

column 8, line 62, after "primary fire" insert --tube--.

Signed and Sealed this

Sixteenth Day of May, 1995

*Attest:*

Bruce Lehman

BRUCE LEHMAN

*Attesting Officer*

*Commissioner of Patents and Trademarks*